US011536450B1

(12) United States Patent
Robbins

(10) Patent No.: US 11,536,450 B1
(45) Date of Patent: Dec. 27, 2022

(54) POWER CHIMNEY SWEEP

(71) Applicant: Vernal Kyle Robbins, Anchor Point, AK (US)

(72) Inventor: Vernal Kyle Robbins, Anchor Point, AK (US)

( * ) Notice: Subject to any disclaimer, the term of this patent is extended or adjusted under 35 U.S.C. 154(b) by 0 days.

(21) Appl. No.: 16/785,623

(22) Filed: Feb. 9, 2020

Related U.S. Application Data

(60) Provisional application No. 62/805,002, filed on Feb. 13, 2019.

(51) Int. Cl.
*F23J 3/02* (2006.01)
*F23J 3/00* (2006.01)

(52) U.S. Cl.
CPC ..... *F23J 3/026* (2013.01); *F23J 3/00* (2013.01)

(58) Field of Classification Search
None
See application file for complete search history.

(56) References Cited

U.S. PATENT DOCUMENTS 4,727,617 A * 3/1988 Bardini ..... F23J 3/026 15/249.1
2004/0216765 A1* 11/2004 Frenette ..... F23J 3/026 134/8
2017/0059157 A1* 3/2017 Meredith ..... F23J 3/026

* cited by examiner

*Primary Examiner* — Mikhail Kornakov
*Assistant Examiner* — Pradhuman Parihar
(74) *Attorney, Agent, or Firm* — Dale Jensen; Dale Jensen, PLC

(57) ABSTRACT

Certain exemplary embodiments can provide a system that comprises an electric motor, an electric motor housing, a cable and a heat shield. the electric motor housing substantially surrounds the electric motor with the exception of a protruding shaft of the electric motor. The cable is coupled to the electric motor, the cable is constructed to rotate within a stovepipe or chimney.

11 Claims, 5 Drawing Sheets

POWER CHIMNEY SWEEP

CROSS-REFERENCES TO RELATED APPLICATIONS

This application claims priority to, and incorporates by reference herein in its entirety, U.S. Provisional Patent Application Ser. No. 62/805,002, filed Feb. 13, 2019

BRIEF DESCRIPTION OF THE DRAWINGS

A wide variety of potential practical and useful embodiments will be more readily understood through the following detailed description of certain exemplary embodiments, with reference to the accompanying exemplary drawings in which.

DETAILED DESCRIPTION

Certain exemplary embodiments can provide a system that comprises an electric motor, an electric motor housing, a cable and a heat shield. The electric motor housing substantially surrounds the electric motor with the exception of a protruding shaft of the electric motor. The cable is coupled to the electric motor, the cable is constructed to rotate within a stovepipe or chimney.

Certain exemplary embodiments clean a stovepipe and/or chimney with the flip of a switch.

Figure 4:
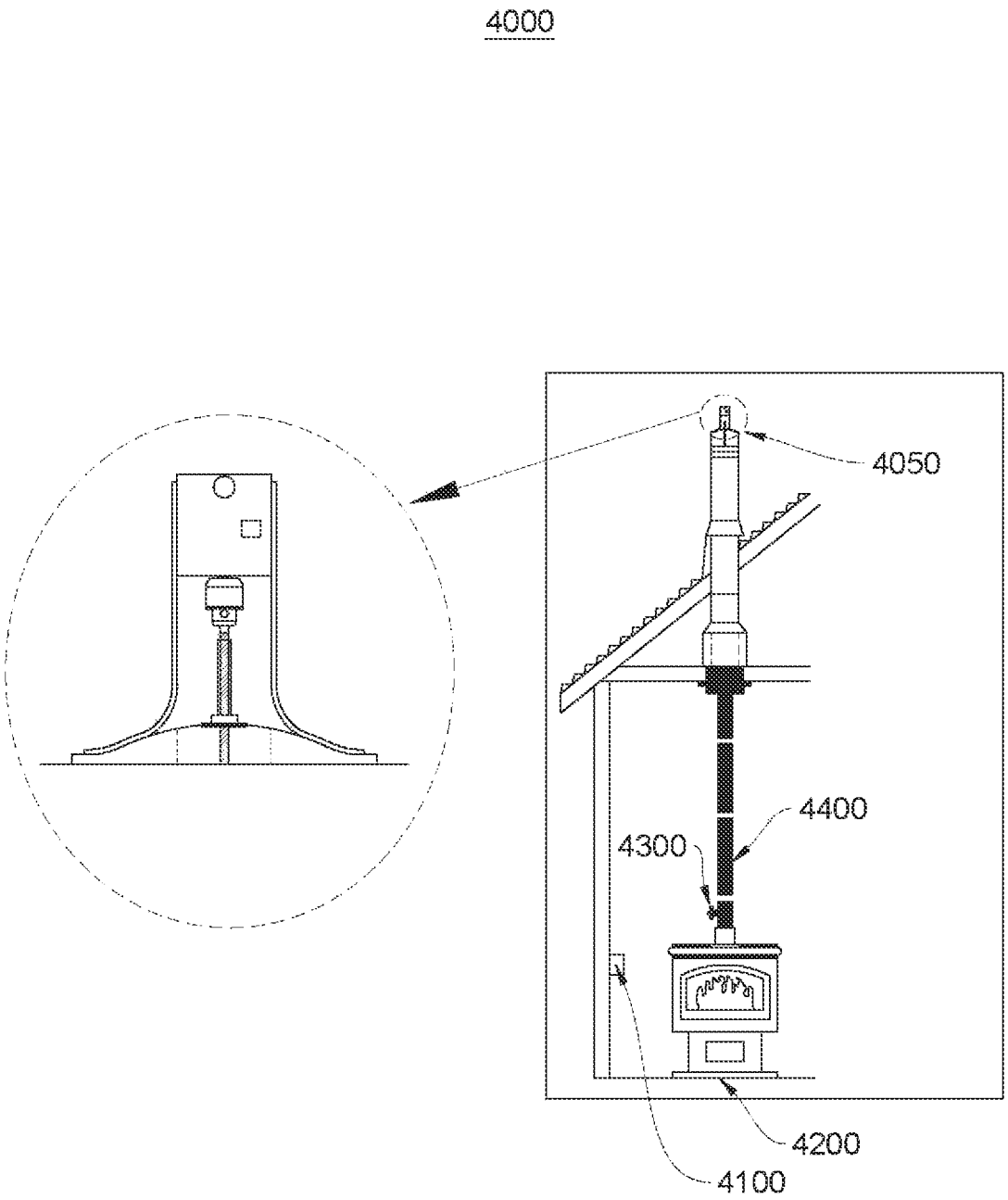
FIG. 4 is a schematic diagram of an exemplary embodiment of a system 4000.

Certain exemplary embodiments are mounted to a top portion of a vent cap of the stovepipe and/or chimney (see, e.g., location 4050 of FIG. 4). In certain exemplary embodiments, a cable can extend down to approximately six inches above a damper (see, e.g., damper 4300 of FIG. 4) of a wood-burning device. The cable can have a small object at its bottom, the small object having a predetermined weight (see, e.g., location 4400 of FIG. 4).

Certain exemplary embodiments allow a user to clean build up, such as ash, from a chimney and/or stovepipe at the same time ash is removed from a wood-burning device (e.g., a wood stove, fireplace, and/or fireplace insert). Regular cleaning can reduce or eliminate the need for messy chimney sweeping and hazardous chimney fires.

Certain exemplary embodiments comprise a motor coupled to a drill chuck that holds a cable that spins to clean the chimney pipe. The motor can have a variable speed that can be adjusted for different pipe sizes. There is also a temperature sensor that will prevent the unit from turning on if the chimney is above a predetermined threshold (e.g., 150 degrees Fahrenheit) so the motor can't be activated with a fire in the wood-burning device. A switch that turns the device on can have a locking door to reduce chances of activation by children or others that may not be permitted to activate the motor.

In a commercial application with pipe sizes greater than approximately six inches in diameter, the motor can ramps up to a desired rotational speed to allow a cable a larger pipe to ramp up centrifugal forces to the inside of the pipe without tangling up the cable.

Certain exemplary embodiments automate cleaning and replaces manual cleaning processes.

Certain exemplary embodiments allow a user to clean buildup (e.g., ash) from a chimney and/or stovepipe, which cleaning can take place at the same time as ash products are cleaned from a wood-burning device. With the flip of a switch, which can be located next to the wood-burning device, buildup in a chimney and/or stovepipe is removed from the walls of the chimney and/or stovepipe and dropped into the wood-burning device with the rest of the ash in approximately fifteen seconds. This allows such buildup to be disposed of with other waste products, such as ash.

Certain exemplary embodiments provide for relatively clean and efficient chimney cleaning compared to climbing on and roof and disassembling the piping. Certain exemplary embodiments can reduce the chance of chimney fires. Certain exemplary embodiments can reduce deaths, injuries, and/or property damage.

Certain exemplary embodiments can mount to the top of an existing chimney cap. Certain exemplary embodiments can be attached with screws. Ash from the chimney falls into the wood-burning device once the ash scraped from the chimney and/or stovepipe wall with the spinning cable.

Certain exemplary embodiments mount to the chimney cap. Certain exemplary embodiments provide a heat shield that provides a barrier from heat after the system is mounted to the stovepipe and/or chimney. Wires that supply the power to the device can be routed inside an insulated tube, which shields the wires from heat.

A fully functioning prototype has proven to function as described herein.

Certain exemplary embodiments can be fixedly coupled to virtually any chimney cap. Certain exemplary embodiments clean the interior walls of any chimney flue with the use of a rotating cable suspended from a drive unit. When the unit is activated, the cable spins at a high rate of speed inside the chimney flue. Centrifugal force causes the cable to make contact with the walls of the flue as it rotates. The rotation forms a perfect screw shaped pattern, much like the action you would create by snaking a drainpipe, only at much higher speeds. With constant contact and rotation against the walls of the chimney, the cable will cause any deposits to break free and fall to the firebox below, where it can be cleaned out and removed.

A prototype was tested and successfully operated over the course of two years. Full cleaning times can range from 3 to 20 seconds, depending on chimney diameter, length, and venting configuration.

The Power Chimney Sweep activation is achieved by a wireless remote, cell phone app, or a hardwired wall switch. Power is applied through a standard 110V, home circuit. It can also be battery powered with a small solar panel too keep the battery charged. This unit uses very little power.

Figure 1:
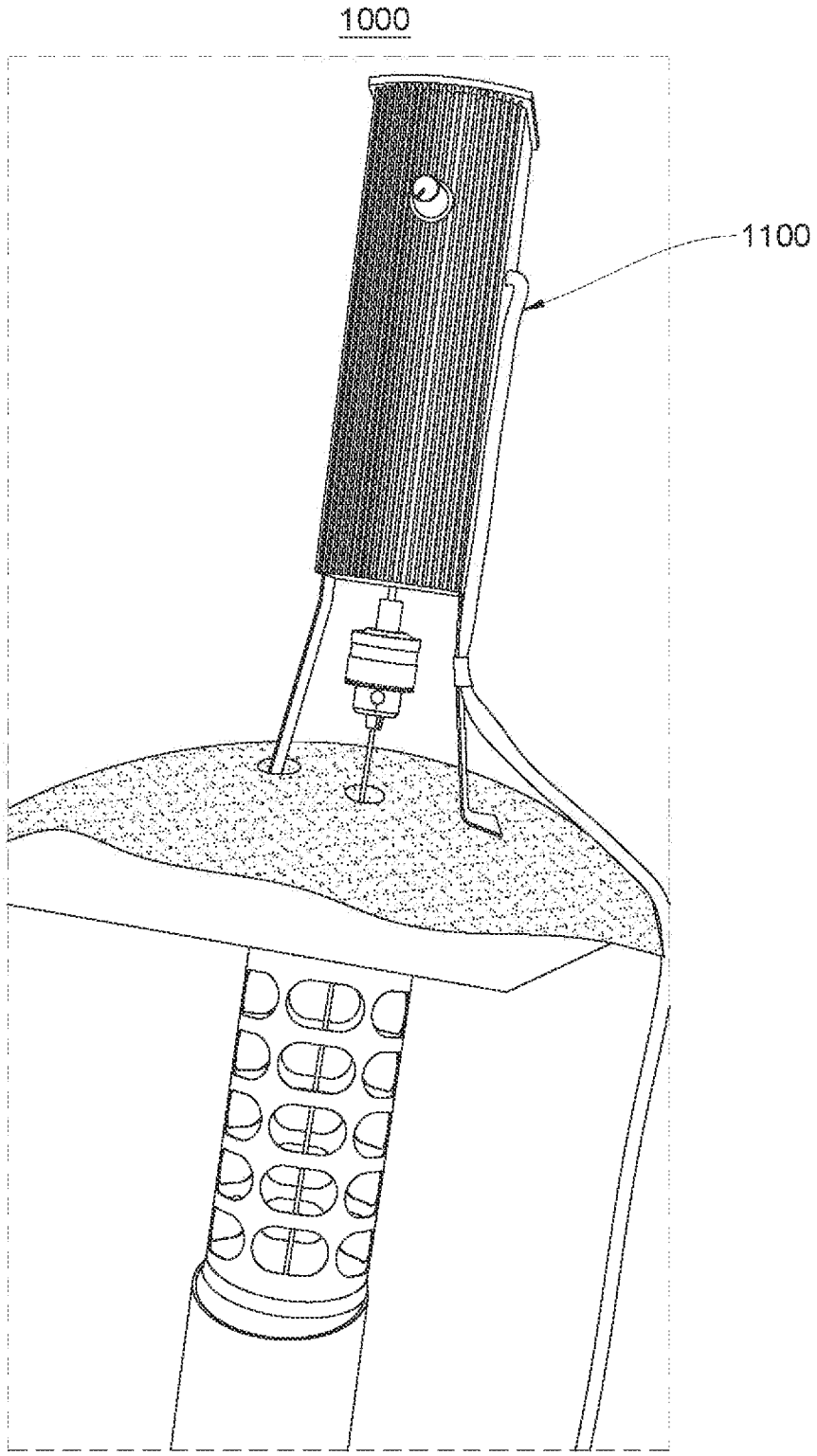
FIG. 1 is a photograph of a perspective view of an exemplary embodiment of a system, 1000.

FIG. 1 is a photograph of a perspective view of an exemplary embodiment of a system, 1000.

Figure 2:
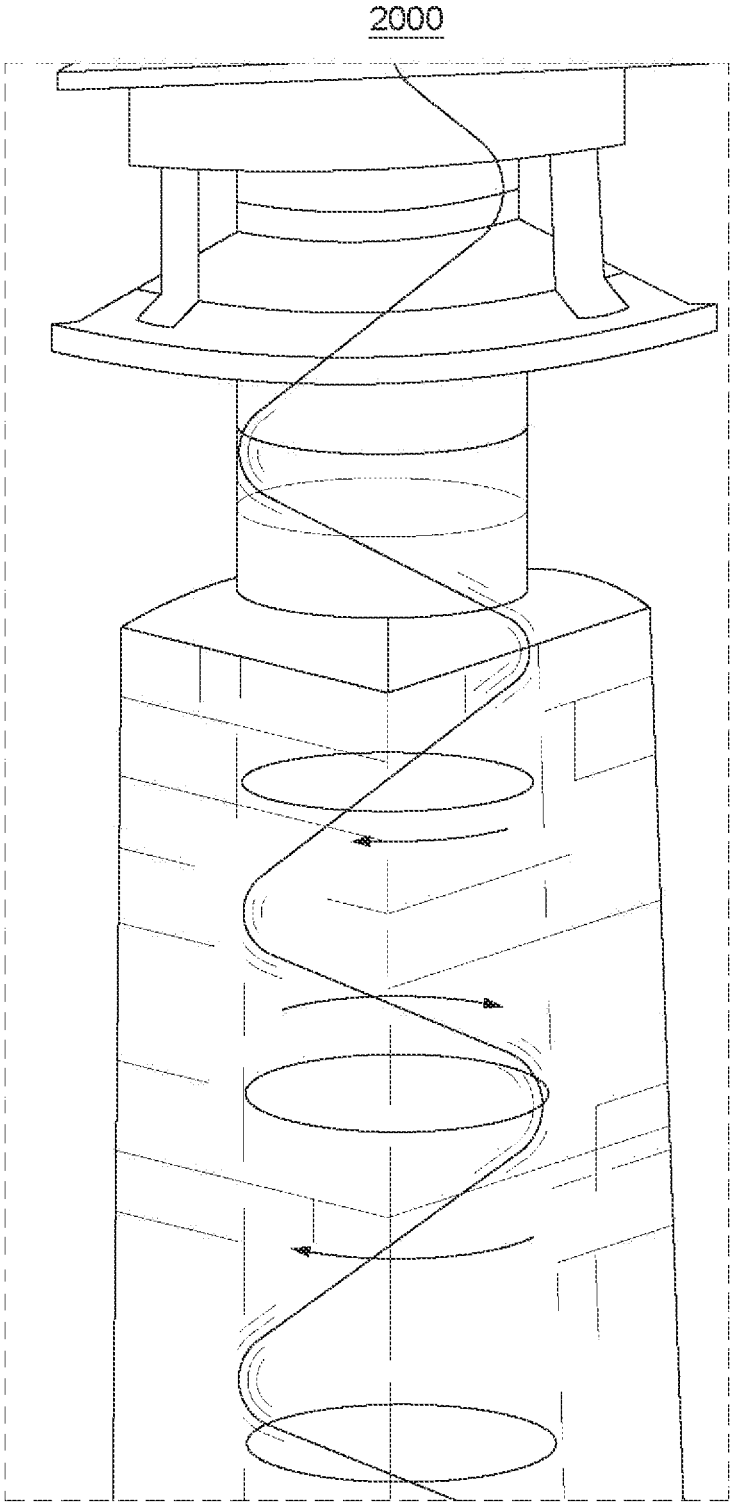
FIG. 2 is a sketch of an exemplary embodiment of a system 2000.

FIG. 2 is a sketch of an exemplary embodiment of a system 2000.

Figure 3:
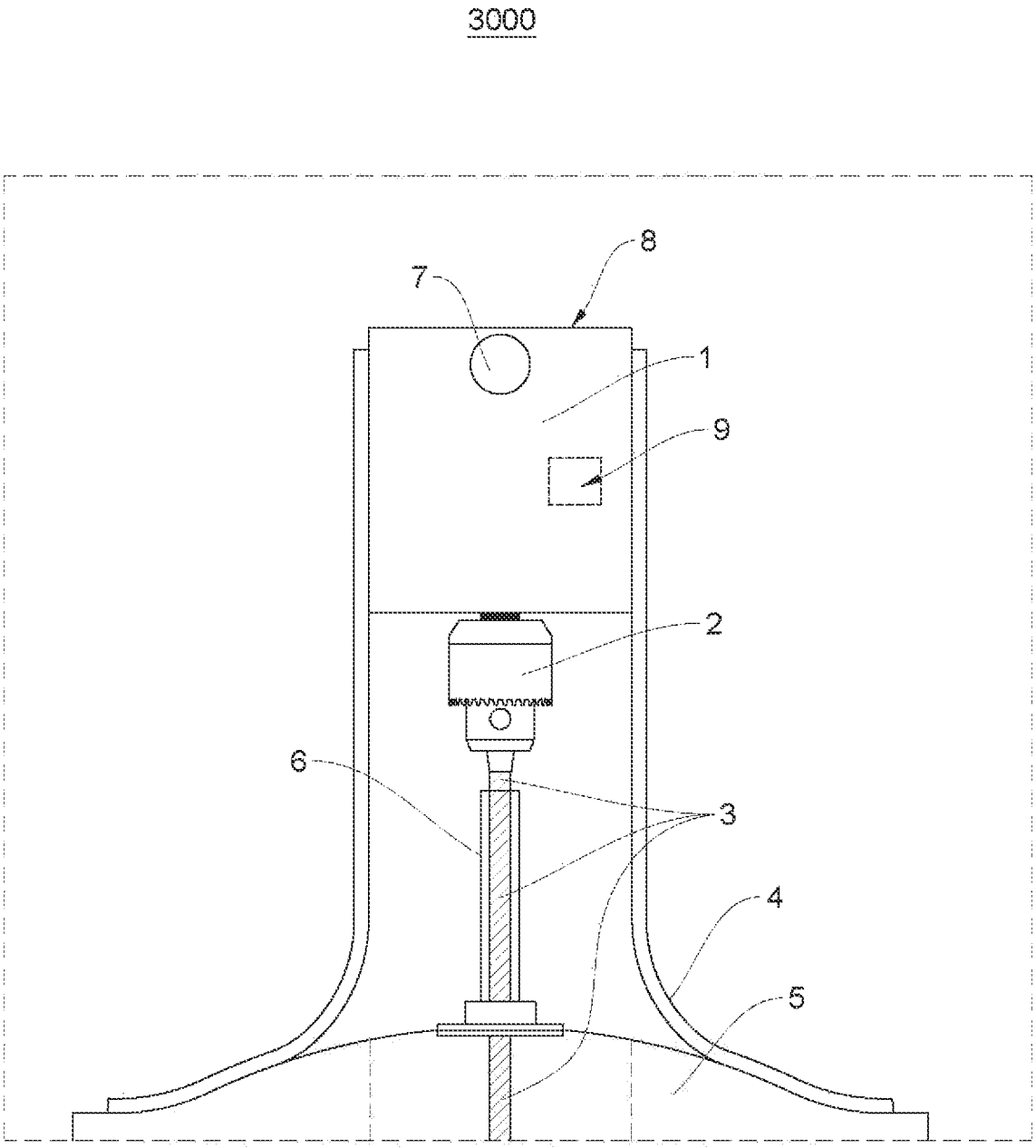
FIG. 3 is a schematic diagram of an exemplary embodiment of a system 3000.

FIG. 3 is a schematic diagram of an exemplary embodiment of a system 3000, which comprises, an electric motor housing 1, a chuck 2, a cable 3, a set of legs 4, a heat shield 5, a cable housing 6, a speed controller 7, an electric motor 8, electric wiring (see electrical wiring 1100 of FIG. 1), a switch (see switch 4100 of FIG. 4), and a wood-burning device (see wood-burning device 4200 of FIG. 4). The wood-burning device coupled to the stovepipe and/or chimney.

Electric motor housing 1 comprises an electric motor (e.g., a drill motor), motor speed controller 7, and a wireless transceiver 9, if wireless option is requested.

A shaft of the electric motor (e.g., a drill motor) extends from the bottom of the electric motor housing 1, and is affixed to chuck 2 (e.g., a drill chuck or sleeve). Cable 3 can comprise steel and can be smooth or barbed. Cable 3 is secured within chuck 2, which can secure cable 3 with setscrews.

Cable can be partially enclosed by heat shield 5 from chuck 2 to the top of the chimney cap, preventing heat from reaching electric motor 8. Cable 3 extends through a chimney cap and hangs down the approximate center of stovepipe and/or chimney to a point approximately six inches above the damper. A steel object can be attached to the end of cable 3 at the damper. The size of the object is determined by cable size and chimney diameter, (e.g., object weight approximately 0.5-1.5 oz. for cable sizes of approximately ⅛ inch to 5/16 inches in diameter).

Speed controller 7 is constructed to tune the rotation speed from approximately 500 RPM to approximately 2,000 RPM, depending on the flue pipe diameter and length (smaller pipe generally utilizes slower speeds).

The electric motor housing can substantially surround the electric motor with an exception of a protruding shaft of the electric motor. The electric wiring coupled to the electric motor, the electric wiring constructed to provide electrical energy to the electric motor. The switch constructed to cause electrical energy to be provided to the electric motor. In certain exemplary embodiments, the switch is located substantially adjacent to a wood-burning device.

The heat shield can be coupled to the electric motor housing via set of legs 4. The heat shield is constructed to be a barrier to heat flow between the stovepipe or chimney and the electric motor. In certain exemplary embodiments, the electric motor has a variable speed. The chuck can be coupled to the electric motor and the cable. The speed controller can be coupled to the electric motor. In embodiments that comprise the speed controller, the speed controller is constructed to adjust the speed of the electric motor.

The cable is coupled, directly or indirectly, to the electric motor. The cable is constructed to rotate within a stovepipe or chimney to effect the cleaning thereof.

FIG. 4 is a schematic diagram of an exemplary embodiment of a system 4000.

Figure 5:
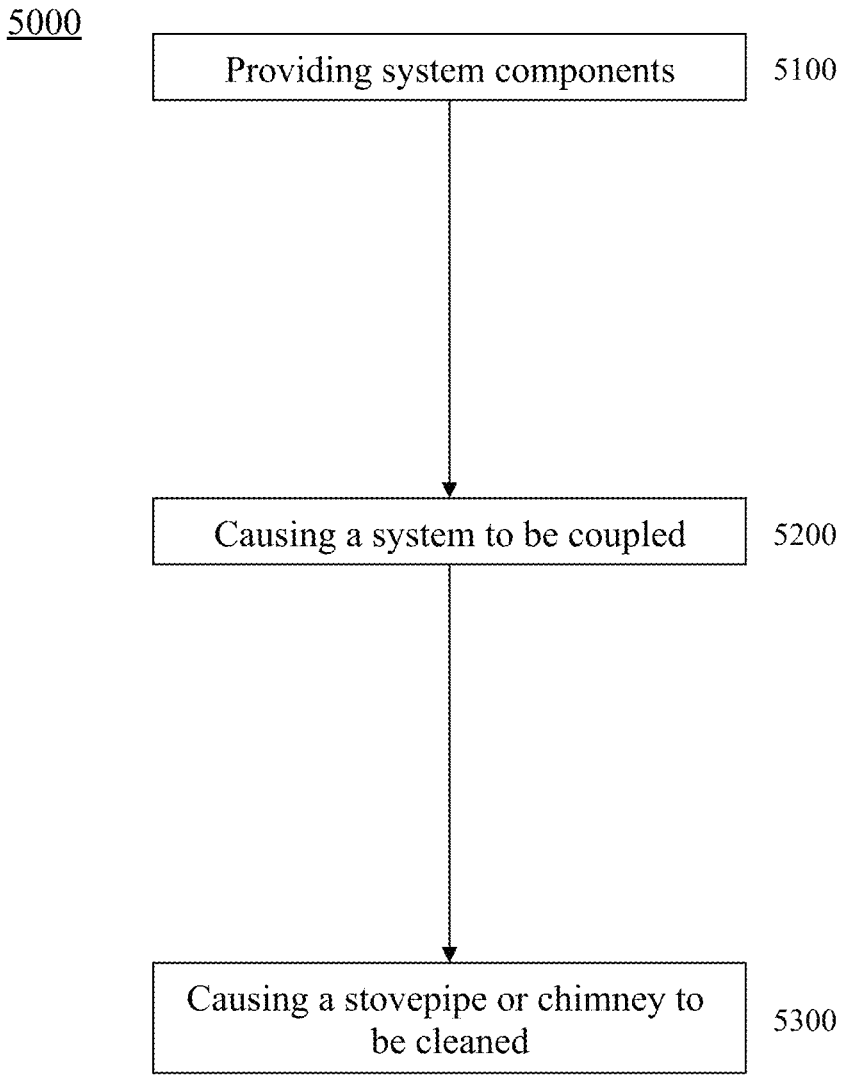
FIG. 5 is a flowchart of an exemplary embodiment of a method 5000.

FIG. 5 is a flowchart of an exemplary embodiment of a method 5000. At activity 5100, system components can be provided. The system comprises an electric motor, an electric motor housing, a cable, and a heat shield. The electric motor housing substantially surrounds the electric motor with the exception of a protruding shaft of the electric motor. The cable is coupled to the electric motor. The cable is constructed to rotate within a stovepipe or chimney. The heat shield is coupled to the electric motor housing via a set of legs. The heat shield is constructed to be a barrier between the stovepipe or chimney and the electric motor.

At activity 5200, certain exemplary embodiments cause the system to be coupled to a stovepipe and/or chimney. At activity 5300, certain exemplary embodiments cause the stovepipe and/or chimney to be cleaned.

Definitions

When the following terms are used substantively herein, the accompanying definitions apply. These terms and definitions are presented without prejudice, and, consistent with the application, the right to redefine these terms during the prosecution of this application or any application claiming priority hereto is reserved. For the purpose of interpreting a claim of any patent that claims priority hereto, each definition (or redefined term if an original definition was amended during the prosecution of that patent), functions as a clear and unambiguous disavowal of the subject matter outside of that definition.

a—at least one.

activity—an action, act, step, and/or process or portion thereof adapter—a device used to effect operative compatibility between different parts of one or more pieces of an apparatus or system.

adjacent—positioned near to something else.

adjust—to change to a sought state.

and/or—either in conjunction with or in alternative to.

apparatus—an appliance or device for a particular purpose associate—to join, connect together, and/or relate.

barrier—a something that obstructs a flow of something and/or obstructs access to something.

cable—a rope comprising metallic fibers.

can—is capable of, in at least some embodiments.

cause—to produce an effect.

chimney—a structure that conveys combustion products away from a wood-burning device.

chuck—a clamping portion of a device that is constructed to couple the device to a cable.

circuit—an electrically conductive pathway and/or a communications connection established across two or more switching devices comprised by a network and between corresponding end systems connected to, but not comprised by the network.

comprising—including but not limited to.

configure—to make suitable or fit for a specific use or situation.

connect—to join or fasten together.

constructed to—made to and/or designed to.

controller—a device and/or set of machine-readable instructions constructed to perform one or more predetermined tasks. A controller can comprise any one or a combination of hardware, firmware, and/or software. A controller can utilize mechanical, pneumatic, hydraulic, electrical, magnetic, optical, informational, chemical, and/or biological principles, signals, and/or inputs to perform the task(s). In certain embodiments, a controller can act upon information by manipulating, analyzing, modifying, converting, transmitting the information for use by an executable procedure and/or an information device, and/or routing the information to an output device. A controller can be a central processing unit, a local controller, a remote controller, parallel controllers, and/or distributed controllers, etc. The controller can be a general-purpose microcontroller, such the Pentium IV series of microprocessor manufactured by the Intel Corporation of Santa Clara, Calif. In another embodiment, the controller can be an Application Specific Integrated Circuit (ASIC) or a Field Programmable Gate Array (FPGA) that has been designed to implement in its hardware and/or firmware at least a part of an embodiment disclosed herein.

convert—to transform, adapt, and/or change.

couple—to link in some fashion.

coupleable—capable of being joined, connected, and/or linked together.

create—to bring into being.
define—to establish the outline, form, or structure of
determine—to obtain, calculate, decide, deduce, and/or ascertain.
device—a machine, manufacture, and/or collection thereof.
electrical—pertaining to electricity.
electric motor—an electrical machine that converts electrical energy into rotational mechanical energy.
electric motor housing—an electrical machine that converts electrical energy into rotational mechanical energy.
electric motor housing—an enclosing, covering, protecting, and/or supporting an electric motor.
heat shield—a barrier that resists a flow of thermal energy.
install—to connect or set in position and prepare for use.
leg—a supporting member.
located—positioned.
may—is allowed and/or permitted to, in at least some embodiments.
member—a structural unit.
method—a process, procedure, and/or collection of related activities for accomplishing something.
plurality—the state of being plural and/or more than one.
predetermined—established in advance.
project—to calculate, estimate, or predict.
provide—to furnish, supply, give, and/or make available.
receive—to get, take, acquire, and/or obtain.
repeatedly—again and again; repetitively.
request—to express a desire for and/or ask for.
rotate—to move or cause to move around an axis or center.
rotational speed—a velocity at which an object turns around a center or an axis. A rotational speed can be expressed in terms of a number of revolutions in a given time period.
select—to make a choice or selection from alternatives.
set—a related plurality.
shaft—a rod in a mechanical drive.
speed—a rotational velocity.
store—to place, hold, and/or retain.
stovepipe—a tube that conveys combustion products away from a wood-burning device.
substantially—to a great extent or degree.
support—to bear the weight of, especially from below.
surround—to enclose on at least four sides.
switch—a device used to close or open an electric circuit or to divert current from one conductor to another.
system—a collection of mechanisms, devices, machines, articles of manufacture, processes, data, and/or instructions, the collection designed to perform one or more specific functions.
variable speed—changeable in rotational velocity.
via—by way of and/or utilizing.
weight—the force with which a body is attracted toward Earth, equal to the product of the object's mass and the acceleration of gravity.
wireless transceiver—a device constructed to transfer signals between sources and destinations without the use of wires.
wiring—insulated electrically conductive strands in the form of a usually flexible thread or slender rod.
wood-burning device—a device in which wood is combusted. For example, wood-burning devices comprise a wood stove, fireplace, and/or fireplace insert.

Note

Still other substantially and specifically practical and useful embodiments will become readily apparent to those skilled in this art from reading the above-recited and/or herein-included detailed description and/or drawings of certain exemplary embodiments. It should be understood that numerous variations, modifications, and additional embodiments are possible, and accordingly, all such variations, modifications, and embodiments are to be regarded as being within the scope of this application.

Thus, regardless of the content of any portion (e.g., title, field, background, summary, description, abstract, drawing figure, etc.) of this application, unless clearly specified to the contrary, such as via explicit definition, assertion, or argument, with respect to any claim, whether of this application and/or any claim of any application claiming priority hereto, and whether originally presented or otherwise:

- there is no requirement for the inclusion of any particular described or illustrated characteristic, function, activity, or element, any particular sequence of activities, or any particular interrelationship of elements;
- no characteristic, function, activity, or element is "essential";
- any elements can be integrated, segregated, and/or duplicated;
- any activity can be repeated, any activity can be performed by multiple entities, and/or any activity can be performed in multiple jurisdictions; and
- any activity or element can be specifically excluded, the sequence of activities can vary, and/or the interrelationship of elements can vary.

Moreover, when any number or range is described herein, unless clearly stated otherwise, that number or range is approximate. When any range is described herein, unless clearly stated otherwise, that range includes all values therein and all subranges therein. For example, if a range of 1 to 10 is described, that range includes all values therebetween, such as for example, 1.1, 2.5, 3.335, 5, 6.179, 8.9999, etc., and includes all subranges therebetween, such as for example, 1 to 3.65, 2.8 to 8.14, 1.93 to 9, etc.

When any claim element is followed by a drawing element number, that drawing element number is exemplary and non-limiting on claim scope. No claim of this application is intended to invoke paragraph six of 35 USC 112 unless the precise phrase "means for" is followed by a gerund.

Any information in any material (e.g., a United States patent, United States patent application, book, article, etc.) that has been incorporated by reference herein, is only incorporated by reference to the extent that no conflict exists between such information and the other statements and drawings set forth herein. In the event of such conflict, including a conflict that would render invalid any claim herein or seeking priority hereto, then any such conflicting information in such material is specifically not incorporated by reference herein.

Accordingly, every portion (e.g., title, field, background, summary, description, abstract, drawing figure, etc.) of this application, other than the claims themselves, is to be regarded as illustrative in nature, and not as restrictive, and the scope of subject matter protected by any patent that issues based on this application is defined only by the claims of that patent.

What is claimed is:

1. A system comprising:

an electric motor;

an electric motor housing, the electric motor housing substantially surrounding the electric motor with an exception of a protruding shaft of the electric motor;

a cable, the cable coupled to the electric motor, the cable constructed to rotate within a stovepipe or a chimney, the cable collinear with the protruding shaft of the electric motor;

a heat shield, the heat shield coupled to the electric motor housing via a set of legs, the heat shield constructed to be a barrier between the stovepipe or chimney and the electric motor; and a cable housing, the cable housing coupled to the heat shield, the cable housing substantially surrounding a portion of the cable between the electric motor and the heat shield.

2. The system of claim 1, wherein:

the electric motor has a variable speed.

3. The system of claim 1, further comprising:

a chuck, the chuck coupled to the electric motor and the cable.

4. The system of claim 1, wherein the cable housing is centered above the stovepipe or chimney.

5. The system of claim 1, further comprising:

a speed controller, the speed controller coupled to the electric motor, the speed controller constructed to adjust a speed of the electric motor.

6. The system of claim 1, further comprising:

electric wiring, the electric wiring coupled to the electric motor, the electric wiring constructed to provide electrical energy to the electric motor.

7. The system of claim 1, further comprising:

a switch, the switch constructed to cause electrical energy to be provided to the electric motor.

8. The system of claim 1, further comprising:

a switch, the switch constructed to cause electrical energy to be provided to the electric motor, wherein the switch is located substantially adjacent to a wood-burning device.

9. The system of claim 1, further comprising:

a wood-burning device, the wood-burning device coupled to the chimney.

10. A method comprising:

causing a stovepipe or a chimney to be cleaned, the stovepipe or the chimney cleaned by a system comprising:

an electric motor;

an electric motor housing, the electric motor housing substantially surrounding the electric motor with an exception of a protruding shaft of the electric motor;

a cable, the cable coupled to the electric motor, the cable constructed to rotate within the stovepipe or the chimney, the cable collinear with the protruding shaft of the electric motor;

a heat shield, the heat shield coupled to the electric motor housing via a set of legs, the heat shield constructed to be a barrier between the stovepipe or the chimney and the electric motor; and a cable housing, the cable housing coupled to the heat shield, the cable housing substantially surrounding a portion of the cable between the electric motor and the heat shield.

11. The method of claim 10, further comprising:

causing the system to be coupled to the stovepipe or the chimney.

* * * * *